United States Patent [19]

Rossmann

[11] 4,361,416

[45] Nov. 30, 1982

[54] ROTOR FOR AXIAL-FLOW TURBOMACHINES

[75] Inventor: Axel Rossmann, Karlsfeld, Fed. Rep. of Germany

[73] Assignee: Motoren- und Turbinen-Union Munchen GmbH, Munich, Fed. Rep. of Germany

[21] Appl. No.: 140,015

[22] Filed: Apr. 14, 1980

[30] Foreign Application Priority Data

Apr. 14, 1979 [DE] Fed. Rep. of Germany ..... 2915286

[51] Int. Cl.[3] ..... F01D 5/30

[52] U.S. Cl. ..... 416/218; 416/214 A

[58] Field of Search ..... 416/214 A, 217, 218, 416/214, 244 A

[56] References Cited

U.S. PATENT DOCUMENTS 4,008,000 2/1977 Gradl ..... 416/218 X 4,102,603 7/1978 Smith et al. ..... 416/244 A

*Primary Examiner*—Leonard E. Smith

*Attorney, Agent, or Firm*—Scully, Scott, Murphy & Presser

[57] ABSTRACT

A rotor for axial-flow turbomachines with a locking pin connection for the blade roots. The blade roots are suspended in fiber-reinforced retaining rings and evidence cylindrical circumferential surfaces at their lower side. These cylindrical surfaces contact a correspondingly conformed circumferential surface on the metallic rotor disc.

6 Claims, 6 Drawing Figures

ROTOR FOR AXIAL-FLOW TURBOMACHINES

BACKGROUND OF THE INVENTION

1. Field of the Invention

The present invention relates to a rotor for axial-flow turbomachines in which the radially slotted blade roots are connected through the intermediary of an axial bolt primarily for the assumption of the tangential forces, to a radial connector of a rotor component and, for assumption of the radial force, with segments arranged in axial succession between the split blade root, and with the segments each being circumferentially encompassed by a common retaining ring having a corresponding curvature and which is constituted of boron, glass or carbon fibers embedded in a heat-resistant matrix.

2. Discussion of the Prior Art

A rotor of this type has already become known from U.S. Pat. No. 4,008,000, the disclosure of which is incorporated by reference herein. During the continuous operation of this rotor the following was determined:

When the encompassing retaining rings deform somewhat ovally or assume an eccentric condition, not only does there occur an imbalance, but even more importantly, there will also increase the centrifugal forces in the region of the increased radial center distance whereas they will reduce in the region of the reduced center distance. This will still further aggravate the oval deformation or the eccentricity which, in turn, will result again in a greater centrifugal load and imbalance, and so forth. There will then occur vibrations until it finally leads to the fracture of the retaining rings and cause failure and possible destruction of the drive structure.

SUMMARY OF THE INVENTION

Accordingly, it is a primary object of the present invention to provide a rotor of the above-described type in which an occasional minor deformation or deflection of the retaining rings will not lead to a fracture of the rotor so as to render the rotor substantially more reliable during operation.

It is a more specific object of the present invention to provide a rotor of the above-described type which is characterized by a rotor component having a coaxial cylindrical circumferential surface against which there contacts at least a portion of the common cylindrical inner surfaces of the split blade foot and the common cylindrical inner surfaces of the segments.

BRIEF DESCRIPTION OF THE DRAWINGS

Reference may now be had to the following detailed description of preferred embodiments of the invention, taken in conjunction with the accompanying drawings; in which.

DETAILED DESCRIPTION

Figure 1:
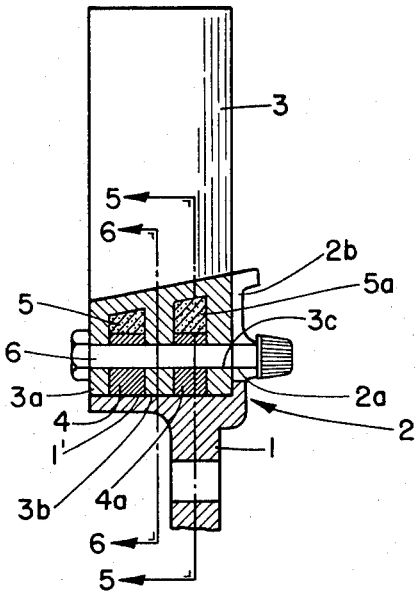
FIG. 1 is a partly sectioned view of a rotor pursuant to the present invention.
Figure 4:
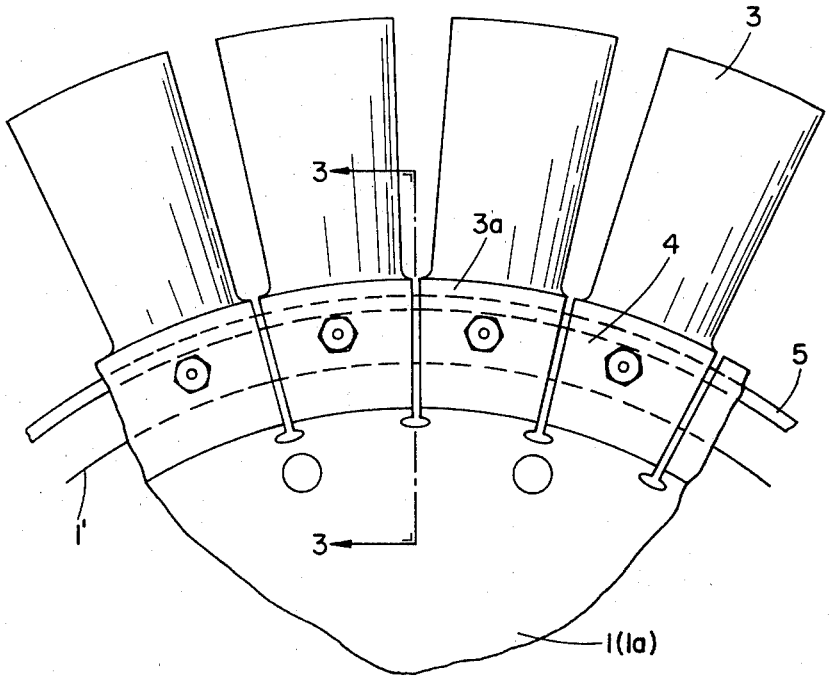
FIG. 4 is a frontal view of FIG. 3.
Figure 2:
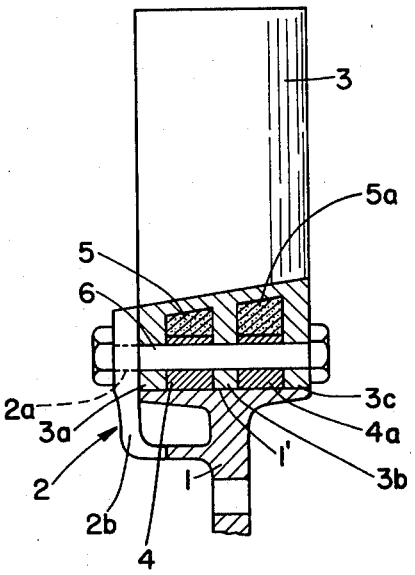
FIG. 2 is a second embodiment of the rotor.
Figure 3:
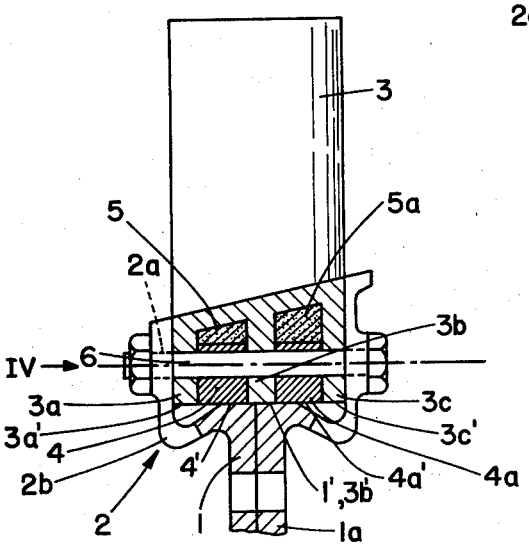
FIG. 3 is a third embodiment of the rotor.
Figure 5:
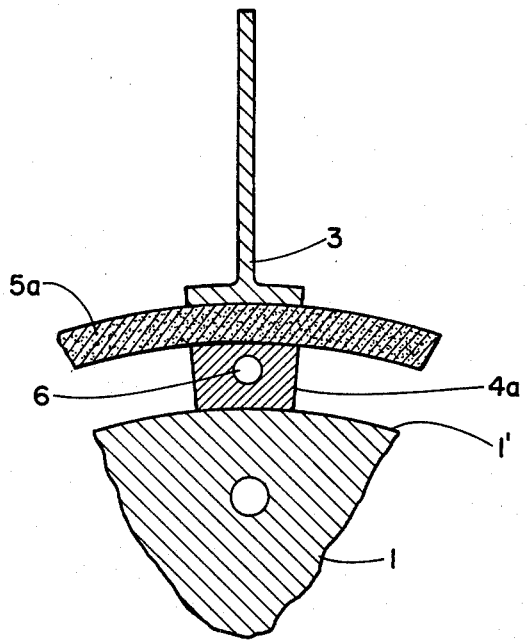
FIG. 5 is a cross-sectional view of FIG. 1 passing through the line V—V.
Figure 6:
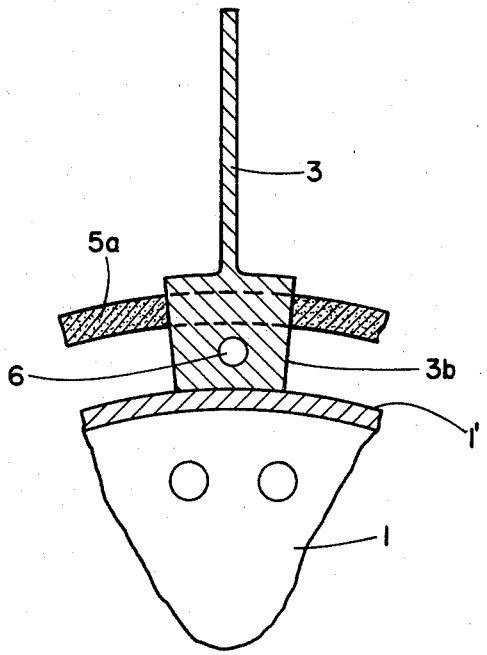
FIG. 6 is a cross-sectional view of FIG. 1 passing through the line VI—VI of FIG. 1.

With reference to FIGS. 1 and 2 of the drawings, the split root portions 3*a*, 3*b* and 3*c* of each of the blades 3 are connected with a lateral, radially extending connector or web 2 and, in the embodiment of FIG. 3, with two radially extending webs 2 encompassing the sides of the slotted root portions, through the intermediary of an axial bolt 6. These webs serve primarily to assume the circumferential forces; for the balancing of stresses the webs evidence radially extending slots 2*b* arranged between respectively two bores 2*a* for each of the axial bolts 6.

Arranged in axial sequence between the slotted blade root portions are segments 4 and 4*a* which are also traversed by the axial bolts 6; and for the receipt of the centrifugal forces they are each encompassed about their circumference by a common, coaxial retaining ring 5 or 5*a* of corresponding curvature which is constituted either of boron, glass or carbon fibers embedded in a heat-resistant matrix.

With reference to FIG. 1, the radial web 2 is formed and is detachably connected to the rotor disc or component 1, on one side of a disc-shaped rotor component 1 and, in essence, proximate its cylindrical circumferential surface 1'.

Pursuant to FIG. 2 the radial web 2 is applied or connected at a point within the cylindrical circumferential surface 1' of a disc-shaped rotor component 1.

In accordance with the embodiment of FIG. 3, the cylindrical circumferential surface 1' is formed on each of two interconnected disc-shaped rotor components 1 and 1*a*, on each of which there is presently formed or attached extending web 2 over a radial inwardly extending curve.

Abutting against these cylindrical circumferential surfaces 1' are common cylindrical inner surfaces 3*a*', 3*b*' and 3*c*' of the slotted blade roots 3*a*, 3*b* and 3*c*, as well as common cylindrical inner surfaces 4' and 4*a*' of the segments 4 or 4*a*. Pursuant to FIG. 3, due to the previously mentioned inwardly formed curve, they can do so only in the axially central region.

When the retaining rings 5 and 5*a* are somewhat ovally deformed or eccentrically deflected during continuous operation, then the split blade roots 3*a*, 3*b* and 3*c* together with their common cylindrical inner surface 3*a*', 3*b*' and 3*c*' will bear against the cylindrical circumferential surface 1' of the rotor component 1 whereby the blades will remain at least approximately in their correct position. Transmitted thereby are only compressive forces on those parts of the circumferential surface whose control affords no difficulty.

What is claimed is:

1. In a rotor for axial-flow turbomachines having radially slotted blade roots; a radially extending web of a rotor component; segments arranged in axial sequence in the split blade root; an axial bolt interconnecting said blade root with said web and said segments primarily for assuming circumferential forces; a common coaxial retaining ring circumferentially encompassing said segments for the assuming of radial forces, said retaining ring having a corresponding curvature and being constituted of a material selected from the group consisting of boron, glass or carbon fibers embedded in a heat-resistant matrix, the improvement comprising: a rotor component having a coaxially extending cylindrical circumferential surface, at least a portion of the common cylindrical inner surfaces of the split blade root and of the common cylindrical inner surfaces of the segments bearing against said circumferential surface.

2. A rotor as claimed in claim 1, said rotor component being disc-shaped, said radial web being formed on one side of said rotor component proximate the cylindrical circumferential surface thereof.

3. A rotor as claimed in claim 1, said rotor component being disc-shaped, said radial web being detachably arranged at a point radially within the cylindrical circumferential surface of said component.

4. A rotor as claimed in claim 1, comprising two of said radially extending webs being formed on said component so as to laterally encompass the slotted blade roots.

5. A rotor as claimed in claim 4, said rotor component comprising two interconnectable disc-shaped members, and a radially extending web being formed on or attached to each of said members.

6. A rotor as claimed in claim 1, said radially extending webs including radially extending slots each extending between two bores for receiving said axial bolts.

* * * * *